US005791824A

United States Patent [19]

Radtke

[11] Patent Number: 5,791,824

[45] Date of Patent: Aug. 11, 1998

[54] INJECTION CABLE BOLT

[76] Inventor: Johannes Radtke, Averdunkshof 7, D-47447 Moers, Germany

[21] Appl. No.: 640,933

[22] PCT Filed: Nov. 11, 1994

[86] PCT No.: PCT/EP94/03730

§ 371 Date: May 1, 1996

§ 102(e) Date: May 1, 1996

[87] PCT Pub. No.: WO95/13453

PCT Pub. Date: May 18, 1995

[30] Foreign Application Priority Data

Nov. 12, 1993 [DE] Germany ..... 9317336 U

[51] Int. Cl.[6] ..... E21D 20/02

[52] U.S. Cl. ..... 405/259.5; 405/259.1; 405/302.2

[58] Field of Search ..... 405/259.1, 259.5, 405/259.6, 302.2; 411/15, 55, 70, 72, 66, 67, 64

[56] References Cited

U.S. PATENT DOCUMENTS

| | | | |
|---|---|---|---|
| 3,494,234 | 2/1970 | Jorge | 405/259.5 |
| 4,247,223 | 1/1981 | Amakasu et al. | 405/259.5 X |
| 4,664,555 | 5/1987 | Herbst | 405/259.5 |
| 4,790,129 | 12/1988 | Hutchins | 405/259.5 X |
| 4,859,118 | 8/1989 | Schaeffer . | |
| 5,586,839 | 12/1996 | Gillespie | 405/259.5 X |

FOREIGN PATENT DOCUMENTS

| | | |
|---|---|---|
| 1 417 029 | 9/1965 | France . |
| 1 201 289 | 9/1965 | Germany . |
| 34 35 117 A1 | 4/1985 | Germany . |
| 39 05 128 A1 | 1/1990 | Germany . |
| 39 02 727 A1 | 8/1990 | Germany . |
| 40 18 703 C1 | 8/1991 | Germany . |
| 42 04 533 A1 | 8/1993 | Germany . |
| WO 91/03622 | 3/1991 | WIPO . |
| WO 93/12324 | 6/1993 | WIPO . |

*Primary Examiner*—Dennis L. Taylor
*Attorney, Agent, or Firm*—Herbert Dubno

[57] ABSTRACT

An injection cable bolt for anchoring in a bore hole of a rock structure as a pressure hose forming its core and having openings therealong through which the injection medium can be forced through a sheath formed by at least one braided layer of high strength filaments surrounding the core and forming a cable therewith. The braids of the sheath open directly toward the bore wall.

7 Claims, 6 Drawing Sheets

INJECTION CABLE BOLT

CROSS REFERENCE TO RELATED APPLICATIONS

This application is a national stage of PCT/EP 94/03730 filed 11 Nov. 1994 and based, in turn, on German National application G 93 17 336.9 filed 12 Nov. 1993 under the International Convention.

FIELD OF THE INVENTION

The invention relates to an injection cable bolt, particularly for mining, tunnelling and embankment construction, as well as for securing rock faces. More particularly, the invention relates to a cable bolt which basically consists of a cable made for instance of heavy duty synthetic or natural textile yarns having a high-pressure hose as a core, surrounded by a net-like support mesh, and which can be provided with a securing element and a sealing element formed by two segments which can be fit one over the other via conically shaped annular surfaces, as well as with a connection element outside the bore which is arranged in a sleeve surrounding the cable.

BACKGROUND OF THE INVENTION

A cable bolt of the type with which the invention is concerned is described in greater detail in German Patent 40 18 703. Such an injection cable bolt has the advantage of an adjusted bendability and consequently can be introduced into narrow, hollow spaces. Furthermore an additional advantage is that such bolts can have greater lengths and can be operated in an extremely simple and safe manner and can more easily be transported.

A drawback of these injection cable bolts is that the is bolt has a core surrounded by the cable and the cable is surrounded by a support grid, which is surrounded by a protective jacket of synthetic material.

It has been found that during injection the protective jacket makes sure that the injection material inside the jacket produces an intimate cementing in the cable, but that the delivery of the injection material over the entire length of the injection cable bolt is not possible to the desired extent. The protective jacket is an impediment for optimal injection. The support grid is tightly embedded in the cement closely to the cable within the jacket, but due to the lack of the widening possibility does not constitute an additional, independently supporting bracing element.

A further disadvantage of the injection cable bolt of the patent is that the connections of securing and connection elements at the opposite cable ends are very complicated and are not attuned to the traction forces to be transmitted through the cable. Also the sealing element provided for sealing the bore, which consists of two superimposable wedge elements, is in need of improvement, as shown by practice, since no active sealing of the two elements is insured solely due to their sliding on top of each other as a result of the pressure medium.

OBJECT OF THE INVENTION

It is therefore, it object of the invention to provide an injection cable bolt for mining, tunnelling and embankment construction, as well as for securing rock faces, which by avoiding the drawbacks of the art, can be used as a simple injection cable bolt, as well as an expandable bolt which makes an optimal injection possible and which can be produced in a simple and cost-effective manner.

SUMMARY OF THE INVENTION

This object is attained according to the invention in an injection cable bolt wherein the securing element is connected with the cable end by means of a shrinking hose. The segments of the sealing element are each constructed of two half-shells which can fit together, whereby the segment facing the bore opening is cylindrically shaped on the inside over its entire length, while the segment which is slid over it is cylindrically shaped on the outside, and the segment which is slid over has on the inside two conically shaped widened areas, pointing in opposite directions away from the cable. The that the sleeve, which can be rigidly connected with the cable end through the shrinking hose or by cementing, surrounds the connection element at least partially, and the connection element has a tube which can be inserted in the core. Alternatively a double-layered or multilayered securing element can be mounted on the cable end.

Advantageously, the securing element, which can be connected by means of a shrinking hose with the cable end pointing towards the deepest area of the bore, has a roof-like cap with a central point and at least lateral injection openings. The roof-like cap can be provided with holding fingers exceeding the diameter of the bore and, for instance, arranged in a stellar manner. The connection of the cable end with the securing element forms a traction-resistant connection, which makes it possible to set the injection cable bolt to the traction force required for expansion, immediately after its introduction into the bore. The star-like array of holding fingers, which represent only one of the embodiments, dig themselves into the bore wall, but leave enough room for the distribution of the injection material through the injection openings provided laterally in the securing element, so this material can penetrate the bore beyond the roof-like cap. It is conceivable to provide at least one central injection opening in the cap, which can be closed for instance by a flap in the manner of a valve.

The individual sections of the sealing element can each be composed of half-shells, which are connectable in the manner of snap-buttons via cog connections, and which in addition can also be cemented. The half-shells can have cogs engaging in the cable on the inside for local anchoring, are easy to assemble, and can be mounted in a simple manner at any desired location of a cable bolt.

The section which can be slid over the fixable section has a particularly advantageous design. The outer side directed towards the bore is cylindrically shaped, while as already mentioned, the inside of this section has two opposite, conical extensions. With one of this conical extensions, which faces the other section, the wedge pushed by the injection medium slides over the lower wedge, thereby enhancing the sealing effect. Since the slide-on section of the sealing element is made of a softer material than the section affixed to the cable and the injection medium penetrates the conical extension under high pressure, the wedge is pressed against the bore wall, thereby completely sealing off the bore, whereby at corresponding locations an additional toothing engages in the bore walling. In order to make possible the escape of the air compressed during injection from inside the bore, it is possible to provide the sections of the sealing element with outer venting slots, running in the direction of the cable.

According to another feature of the invention the cable end pointing towards the bore opening, or located outside the bore, is provided with a sleeve in the form of a shrinking hose, or can be provided with a jacket which can be connected with the cable end in a traction-resistant manner.

The connection element can be provided can be provided with a threading or a rapid action coupling. This can be done by means of a shrinking hose, whereby the shrinking hose surrounds at least partially the cable end and the connection element. In order to use such an injection cable bolt as a tension rod it is advantageous to cement the cable end in an inner, e.g. roughened jacket, so that a tie plate can be slid on and a bracing nut can be screwed onto it. In all embodiments the connection element is connected with a metallic or plastic tube, which is at least partially introduced into the core inside the cable.

The core inside the cable is a high-pressure hose adapted to the respective injection pressure, which can be provided with an integrated support mesh, so that its cross section is not narrowed while the cable is braided around the core during manufacturing. Depending on the injection to be performed, it is possible to make the core inside the cable, over its entire length, without a corresponding perforation or slot. Otherwise it is possible to make the core, over its entire or partial length, with perforations, or openings.

Depending on the use of the cable, it can be made of polyethylene, polyester, Kevlar, aramide, Nylon, glass fiber, carbon, filaments in yarn or fiber form or of a mixture of the mentioned materials, so that it has the strength.

The cable interweaving can be single-layered or multilayered, whereby the used yarn can be of different strength. Furthermore different types of interweaving can be selected, depending on the task to be performed. In order to insure the propagation of the injection material over the entire bolt length, it is suitable to produce the cable with a corresponding mesh width. Furthermore it is possible to reinforce the cable for instance by weaving in metal wire, whereby at the same time an antistatic behavior is achieved.

Within the framework of the invention it is further possible to surround the cable with an outer fine-meshed texture layer for the purpose of limiting the injection material, in order to reduce excessive consumption of the injectable material, e.g. in fractured loose rock. Otherwise the cable can be provided with a thin outer membrane destructible during injection, in order for instance to press inwardly the construction joints which occur during the concrete work in different layers.

Besides the antistatic design of cable and support mesh, the cable bolts can also be designed based on various flame-retardant fibers or with additional flame-retardant coatings.

BRIEF DESCRIPTION OF THE DRAWING

The above and other objects, features, and advantages will become more readily apparent from the following description, reference being made to the accompanying drawing in which.

Several embodiments of the invention are represented in the drawing and are subsequently closer described. It shows.

SPECIFIC DESCRIPTION

Figure 8:
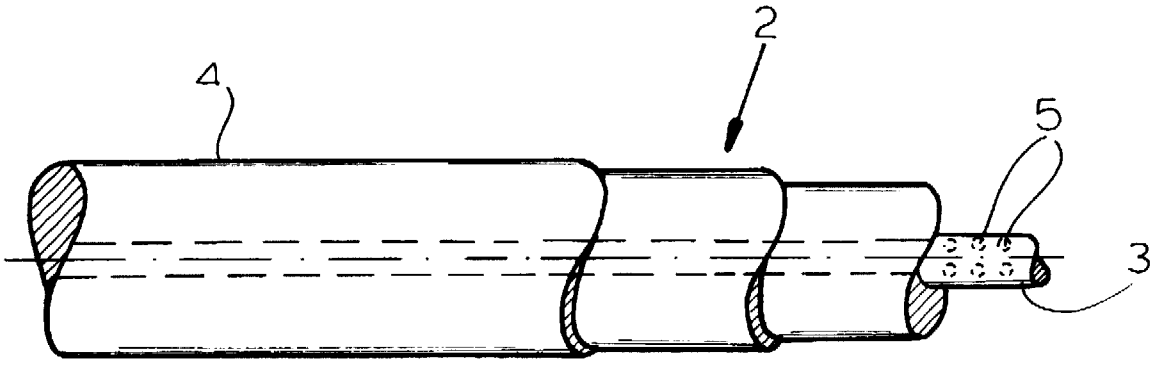
FIG. 8 and 9 are diagrammatic sectional views of two embodiments of a multilayered cable with a perforated and a nonperforated core.
Figure 9:
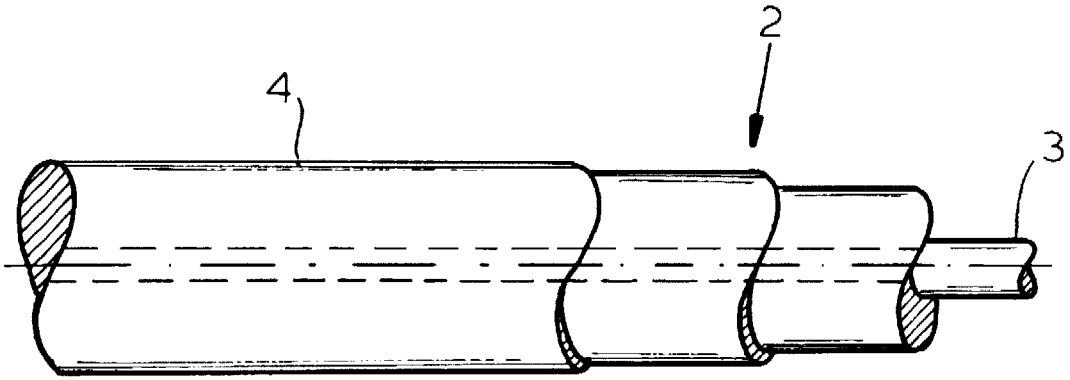

The cable 2 used for different embodiments of injection cable bolts is represented in FIGS. 8 and 9 in two multilayered embodiments. The multilayered cable 2 is surrounded by a support mesh 4 of synthetic or steel braiding and has a core 3, which can be inserted with or without integrated support braiding, and with or without perforations on openings 5 (FIG. 8). The support mesh can be an interweaving of various yarns, to which metallic threads are added for antistatic purposes.

Figure 1:
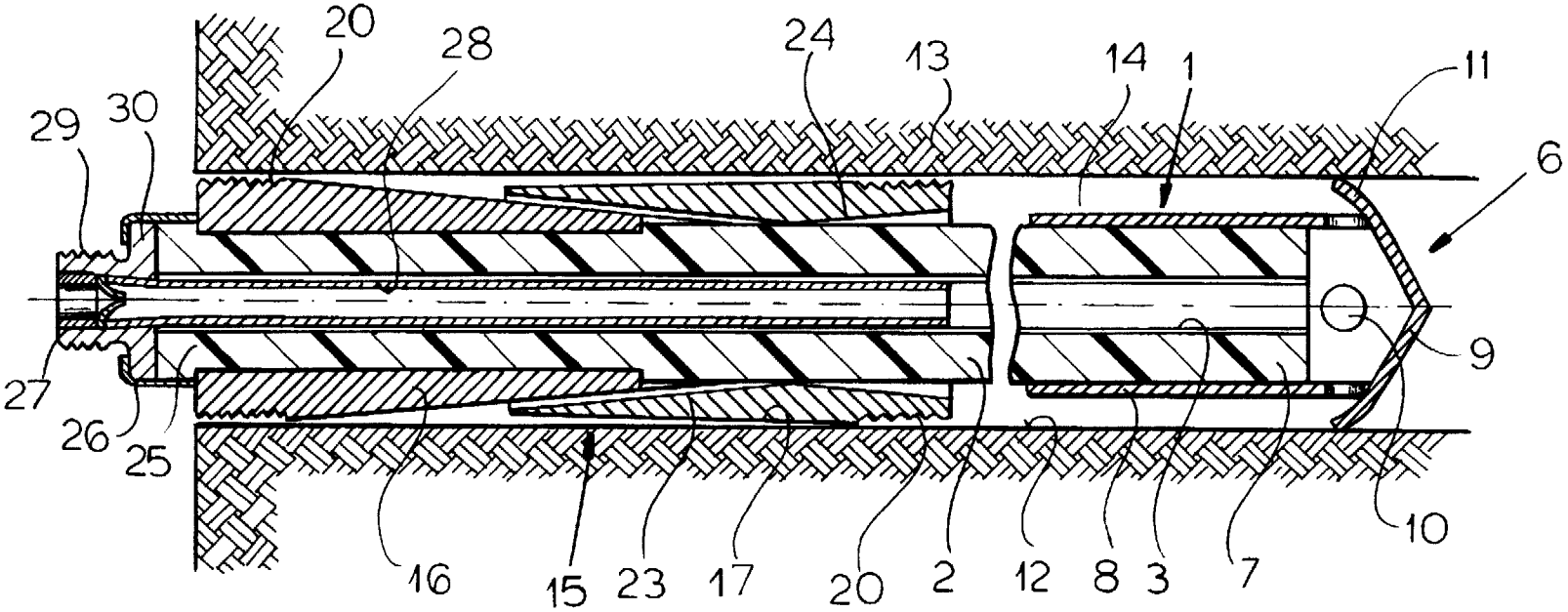
FIG. 1 is a longitudinal section through an embodiment of the injection cable bolt of the invention.

In the sectionof FIG. 1, a cable bolt 1 arranged inside a bore in rock or mineral 13. The cable bolt 1 consisting of a cable 2 with an inner core 3 has a securing element 6 at the deep cable end 7 which is provided with lateral injection openings 10 and a roof-like point 9. The securing element 6 is tightly connected with the cable end 7 by means of a shrinking hose 8. The securing element 6 has holding fingers 11, which have a greater cross section than the bore 12 and which engage in the bore wall during the retraction of the cable bolt 1.

Further the cable bolt 1 has a sealing element consisting of two sections 16 and 17 which can slide on top of each other. Each of the sections 16 and 17 consists of two half-shells 18, which can be joined by means of cog connections 19 in the manner of snap-buttons and in addition can be cemented to each other.

The section 16 is fastened on the cable 2 at a correspondingly provided location at the bore opening or inside the bore 12, whereby the cogs 21 on the inside of the half-shell 18 press themselves into the cable, so that section 16 is immovably arrested.

The section 17 of the sealing element 15, which can be slid over the section 16, is cylindrically shaped on its outside and on the inside has two conical extensions 23, 24, tapered oppositely in the longitudinal direction of the cable. Advantageously the section 17 is made of a softer material than section 16. Due to the pressure of the injection medium, the section 17 slides over the section 16 and the injection medium penetrates into the extension 24 and presses the section 16 with the corresponding toothing provided at the margins in such a way against the bore wall, that a complete sealing is achieved.

Figure 2:
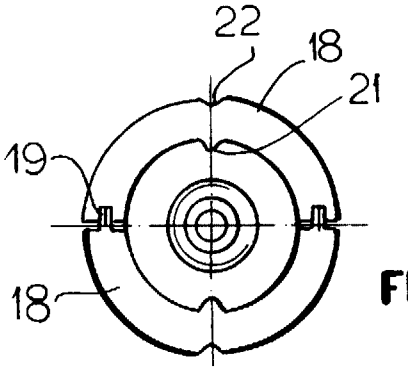
FIG. 2 is a transverse section through the embodiment example shown in FIG. 1.
Figure 5:
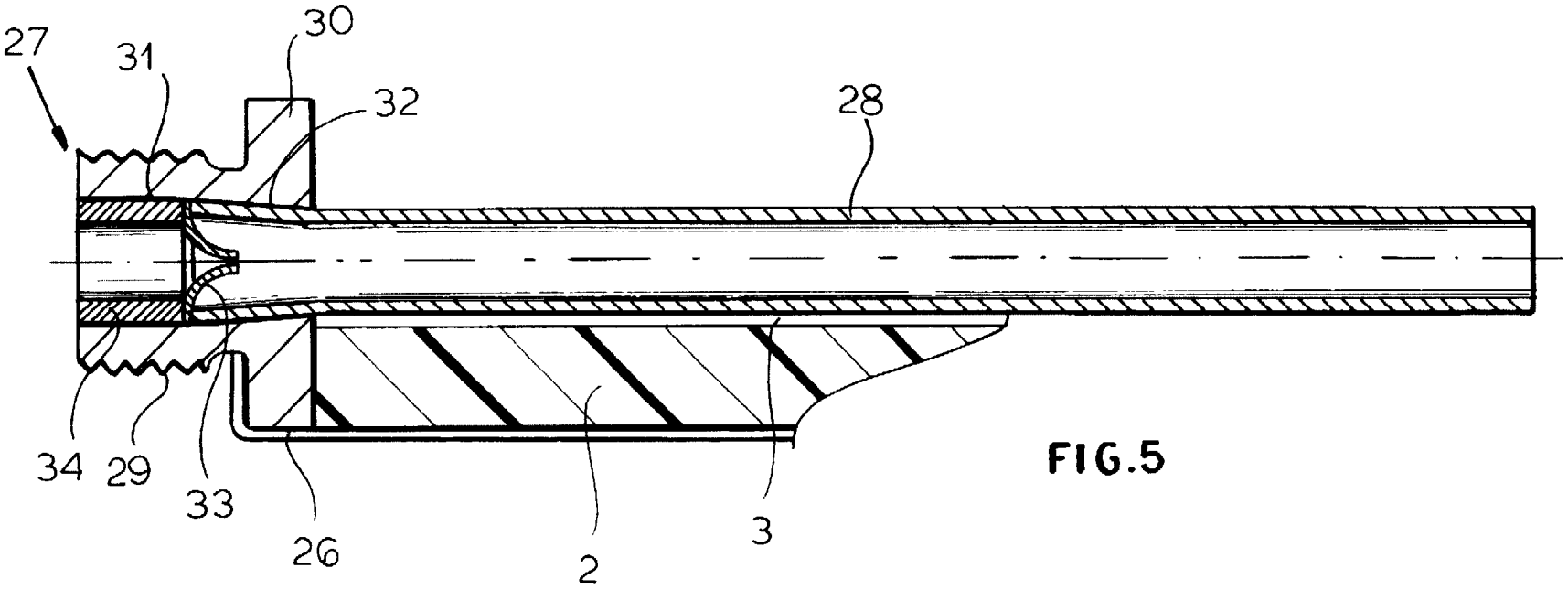
FIG. 5 is a partial longitudinal section through the end of a injection bolt.

For connection of a hose duct for injection at the cable end 25 protruding from the bore 12 a connection element 27 is provided, which by means of a shrinking hose 26 partially enveloping the shoulders 30 of the connection element 27, can be rigidly connected to the cable end 25. The details inside the connection element 27 are illustrated in greater detail in FIG. 5. The embodiment of FIGS. 1 and 2 can be characterized as a pure injection cable bolt.

Instead of the shrinking hose 26, the cable end 25 can be surrounded by a two-shell or multiple shell element for the fixation of the tube 28 inserted in the core 3.

Figure 3:
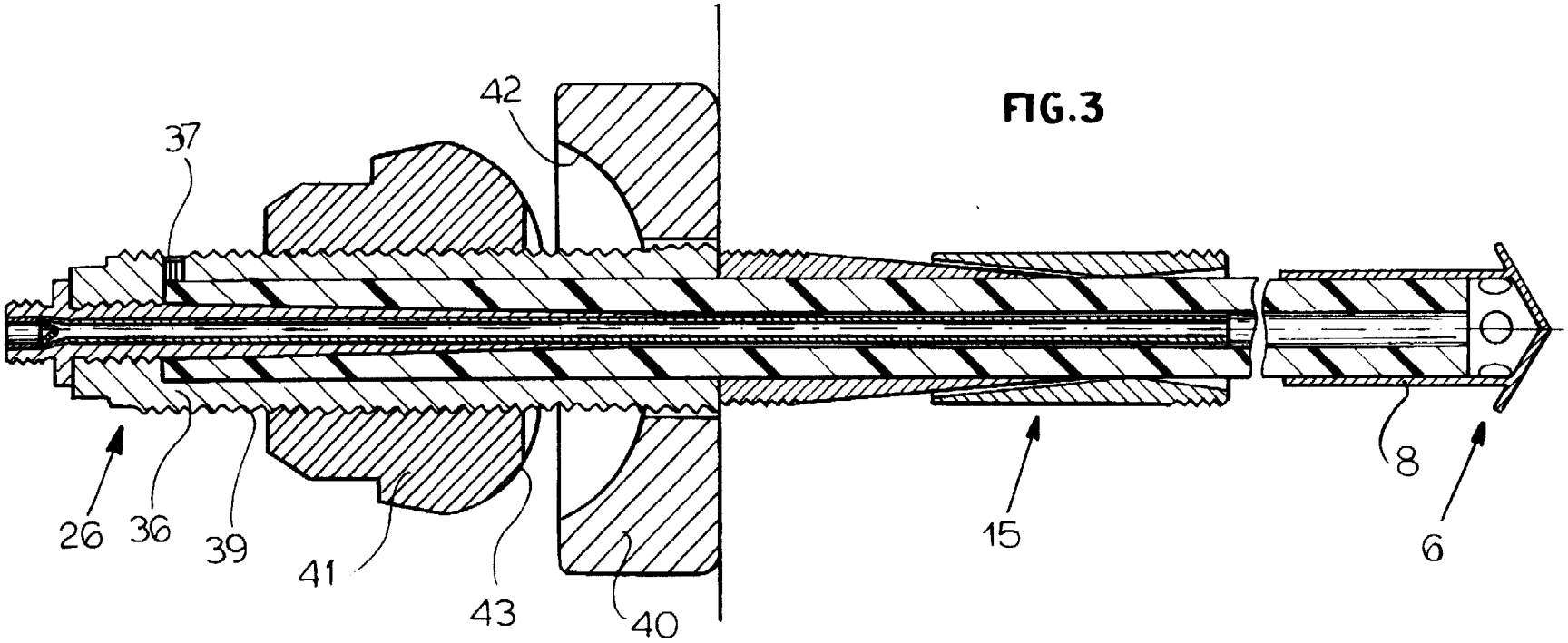
FIG. 3 is a longitudinal section through an embodiment of the injection cable bolt of the invention used as a tension rod.
Figure 4:
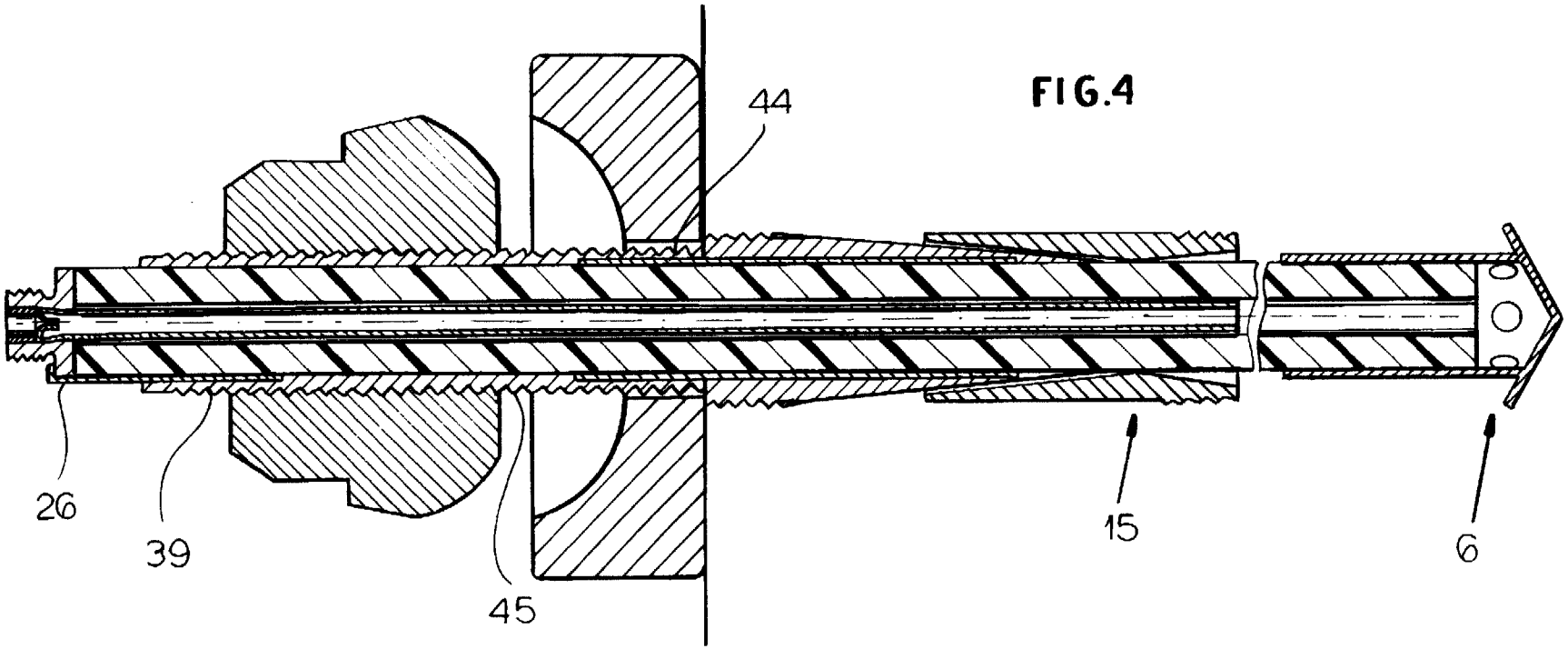
FIG. 4 is a longitudinal section through a further embodiment of the injection cable bolt of the invention used as tension rod.

The embodiments of FIGS. 3 and 4 are injection cable bolt which are used as tension rods. The embodiment of FIG. 3 differs from the embodiment of FIG. 1, in that the cable end 25 which is outside the bore 12 is arranged in a jacket 36 designed as a sleeve 26. The jacket 36 which can be made of metal or plastic material, has a thread 39 on the outside and makes possible for a tie plate 40 on the one hand to slide on top, and on the other hand makes possible the bracing of the tie plate 40 by means of the bracing nut 41. The anchor tie 40 has a spherical recess 42 and the bracing nut 41 has a rounding 43 corresponding with the recess 42. Further details of this embodiment are given in FIGS. 6 and 7.

Figure 6:
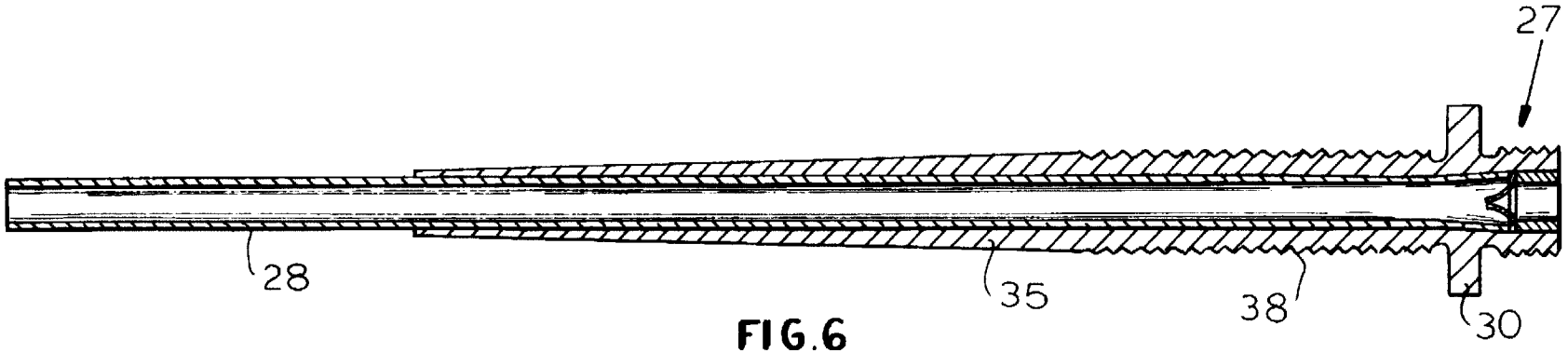
FIG. 6 is a longitudinal section through an embodiment of a connection element in cooperation with the tube.
Figure 7:
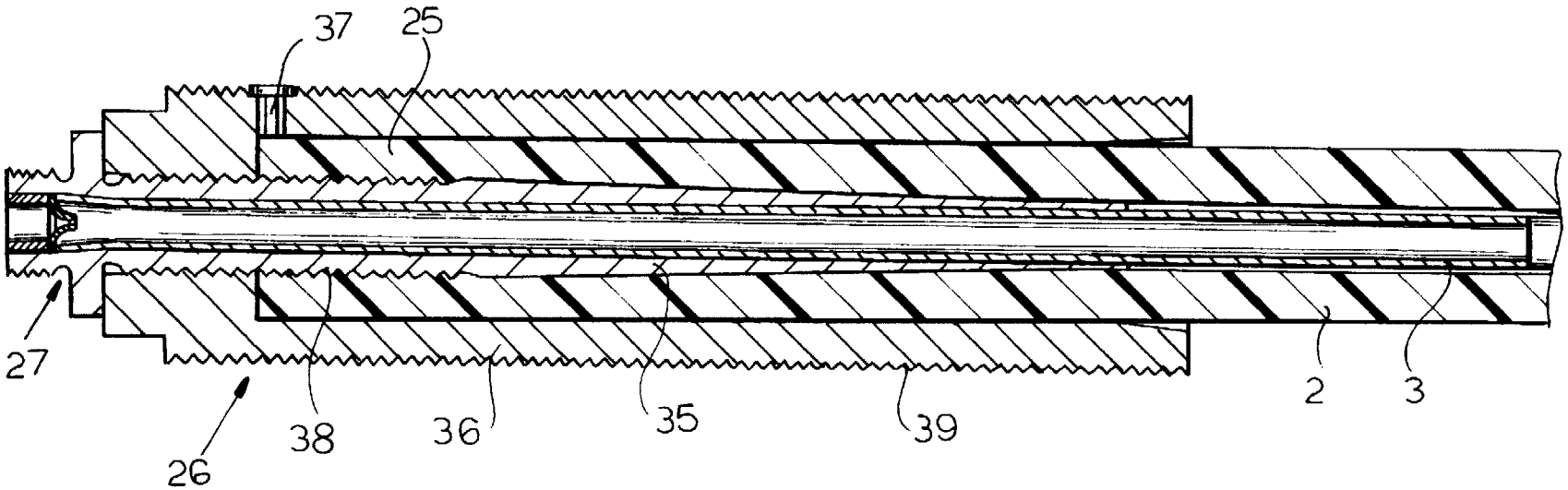
FIG. 7 is a longitudinal section through an embodiment of a sleeve for a tension rod affixed to the cable end.

In FIG. 6 it is indicated that the connection element 27 is connected with a tube 28 which can at least partially be introduced into the core 3, and which furthermore is surrounded by a wedge 35 with a threading 38. This wedge can be screwed into an opening of the jacket 36 and braces the cable 2 inside the jacket 36. After the insertion of the tube 28 in the jacket 36, respectively in the cable 2, the cable end 25 is intimately cemented inside the jacket 36, through injection via an injection opening 37. Inside the connection element 27, which as already mentioned can be provided with a thread 29 or a rapid connection coupling, according to FIG. 5 a cylindrical segment 31 and a conically narrowing segment 32 are provided, whereby check valve 33 in the form of a lip seal is arranged between the end of the tube 28 and an annular plug 34 provided for safety. From the embodiment example shown in FIG. 5 it is also clear that the tube 28 is introduced into the core 3 and that the shrinking hose 26 surrounds the connection element partially in the area of shoulder 30, thereby creating a rigid connection.

In FIG. 4 a further embodiment of an injection cable bolt designed as a tension rod is shown, wherein for the integration of the connection element 27 into the cable end 25 a shrinking hose 26 is provided, and at a distance therefrom around the cable 2 a further shrinking hose segment 44 is provided. Between the segments 26 and 44 a jacket 45 with a threading 39 is applied for instance through an injection die casting process, by means of which the bracing of the tie plate 40 is insured by the bracing nut 41 (see FIG. 3).

The openings 5 in the core 3 shown in FIG. 8 can also be slots running in the longitudinal direction of the core. In this way, during injection, at first outward flow of the injected material starts in the deepest area of the bores, then due to the pressure buildup the slots are subsequently opened and an outward injection takes place over the entire cable length.

I claim:

1. An injection cable bolt for anchoring in a borehole of a rock structure by the injection of an injection medium there through into said borehole, said injection cable bolt comprising:

a high pressure hose forming a core and provided at an end with a fitting through which said injection medium is injectable, said hose being formed with openings through which said injection medium is distributed outwardly from said core;

at least one braided layer of high strength filaments surrounding said core and forming a cable with said core, said layer being open directly to the interior of said bore for distributing said injection medium to said bore over the entire periphery of said braided layer without confinement between said braided layer and said bore;

sealing means between said cable and said bore proximal to a mouth of said bore and including an inner frustoconical section surrounding said cable and an outer frustoconical section clamped between said inner frustoconical section and a wall of said bore; and means at an inner end of said cable for closing said bore and confining said injection medium.

2. The injection cable bolt defined in claim 1 wherein said braided layer is composed of filaments selected from the group consisting of polyethylene, polyester, kevlar, aramide, nylon, glass, carbon and mixtures thereof.

3. The injection cable bolt defined in claim 1 wherein said cable comprises at least one inner braided layer and an outer braided layer of a fine mesh.

4. The injection cable bolt defined in claim 1 wherein said layer contains steel wire.

5. The injection cable bolt defined in claim 1, further comprising an externally threaded jacket surrounding said cable at an end of said cable projecting from said bore and a bracing nut threaded onto said jacket.

6. The injection cable bolt defined in claim 1, further comprising a tie plate having a recess, said nut being shaped to fit said recess.

7. The injection cable bolt defined in claim 6 wherein said recess is spherically concave and said nut is spherically convex.

* * * * *